US010420987B2

(12) United States Patent
Kimizuka et al.

(10) Patent No.: US 10,420,987 B2
(45) Date of Patent: Sep. 24, 2019

(54) GOLF CLUB HEAD AND METHOD FOR PREDICTING CARRY DISTANCE PERFORMANCE THEREOF

(75) Inventors: Wataru Kimizuka, Kobe (JP); Masahide Onuki, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 719 days.

(21) Appl. No.: 13/560,098

(22) Filed: Jul. 27, 2012

(65) Prior Publication Data

US 2013/0029783 A1 Jan. 31, 2013

(30) Foreign Application Priority Data

Jul. 28, 2011 (JP) ..... 2011-165796

(51) Int. Cl.
*A63B 53/04* (2015.01)

(52) U.S. Cl.
CPC .. *A63B 53/0466* (2013.01); *A63B 2053/0408* (2013.01); *A63B 2053/0433* (2013.01); *A63B 2053/0437* (2013.01); *A63B 2053/0445* (2013.01); *A63B 2053/0454* (2013.01); *A63B 2053/0462* (2013.01); *A63B 2053/0491* (2013.01); *A63B 2209/023* (2013.01)

(58) Field of Classification Search
CPC ..... A63B 53/0466; A63B 2053/0445; A63B 2053/0454; A63B 2209/023; A63B 2053/0433; A63B 2053/0491; A63B 2053/0437; A63B 2053/0408; A63B 2053/0462
USPC ..... 473/292, 345, 349
See application file for complete search history.

(56) References Cited

U.S. PATENT DOCUMENTS

| | | | | |
|---|---|---|---|---|
| 5,058,895 | A * | 10/1991 | Igarashi | A63B 53/04 473/341 |
| 5,152,527 | A * | 10/1992 | Mather | A63B 60/24 473/291 |
| 5,772,526 | A * | 6/1998 | Hano | 473/314 |
| 5,836,830 | A | 11/1998 | Onuki et al. | |
| 6,193,614 | B1 * | 2/2001 | Sasamoto | A63B 53/04 473/329 |

(Continued)

FOREIGN PATENT DOCUMENTS

| | | | |
|---|---|---|---|
| JP | 8-187308 | A | 7/1996 |
| JP | 2000-308700 | A | 11/2000 |
| JP | 2006-288882 | A | 10/2006 |

*Primary Examiner* — William M Pierce
(74) *Attorney, Agent, or Firm* — Birch, Stewart, Kolasch & Birch, LLP

(57) ABSTRACT

A hollow golf club head has: a moment of inertia Ix around a vertical axis of 4500 to 5900 g sq·cm; and a moment of inertia Iy around an inclined axis of 5300 to 6800 g sq·cm, which satisfy Iy=<1.071 I×Ix+482 g sq·cm. The vertical axis passes through the center of gravity of the head under a standard state in which the head is set on a horizontal plane so that a shaft center line is inclined at a lie angle of 60 degrees with respect to the horizontal plane within a vertical plane and a club face lies at the loft angle. The inclined axis passes through the center of gravity of the head and is inclined downwardly toward the toe from the heel at 62 degrees with respect to the horizontal plane within a plane parallel with the above-mentioned vertical plane.

7 Claims, 11 Drawing Sheets

(56) References Cited

U.S. PATENT DOCUMENTS 6,364,787 B1 * 4/2002 Huiskamp ..... A63B 53/14 473/292
6,488,595 B1 * 12/2002 Grace ..... 473/341
6,695,712 B1 * 2/2004 Iwata ..... A63B 53/04 473/291
6,811,496 B2 * 11/2004 Wahl ..... A63B 53/047 473/334
6,814,674 B2 * 11/2004 Clausen ..... A63B 53/0466 473/342
7,137,905 B2 * 11/2006 Kohno ..... 473/314
7,413,520 B1 * 8/2008 Hocknell ..... A63B 53/0466 473/345
7,500,924 B2 * 3/2009 Yokota ..... A63B 53/0466 473/332
7,510,485 B2 * 3/2009 Yamamoto ..... 473/345
7,559,851 B2 * 7/2009 Cackett ..... A63B 53/0466 473/300
7,621,822 B2 * 11/2009 Roach ..... A63B 53/047 473/329
7,749,103 B2 * 7/2010 Nakano ..... 473/345
7,775,907 B2 * 8/2010 Hirano ..... 473/349
7,824,277 B2 * 11/2010 Bennett ..... A63B 53/0466 473/328
7,887,436 B2 * 2/2011 Hirano ..... 473/345
8,083,609 B2 * 12/2011 Burnett ..... A63B 53/0466 473/327
8,235,841 B2 * 8/2012 Stites ..... A63B 53/0466 473/328
8,430,763 B2 * 4/2013 Beach ..... A63B 53/06 473/307
8,435,137 B2 * 5/2013 Hirano ..... 473/345
8,480,514 B2 * 7/2013 Hartwell ..... A63B 53/047 473/342
8,517,859 B2 * 8/2013 Golden ..... A63B 53/0466 473/329
8,636,608 B2 * 1/2014 De la Cruz et al. ..... 473/345
8,821,312 B2 * 9/2014 Burnett ..... A63B 49/06 473/329
8,827,831 B2 * 9/2014 Burnett ..... A63B 49/06 473/329
8,876,622 B2 * 11/2014 Beach ..... A63B 53/02 473/244
8,900,069 B2 * 12/2014 Beach ..... A63B 53/06 473/329
8,986,133 B2 * 3/2015 Bennett ..... A63B 59/0092 473/329
9,033,818 B2 * 5/2015 Myrhum ..... A63B 53/0466 473/329

* cited by examiner

E1 cross section

GOLF CLUB HEAD AND METHOD FOR PREDICTING CARRY DISTANCE PERFORMANCE THEREOF

BACKGROUND OF THE INVENTION

The present invention relates to a golf club head capable of improving a carry distance of a stuck ball and a method for predicting the carry distance performance thereof.

There has been known a golf club head which is, in order to improve the average carry distance of stuck balls, increased in the moment of inertia Ix around a vertical axis passing through the center of gravity of the head in a standard state in which the head is set on a horizontal plane so that the shaft center line is inclined at the lie angle within a vertical plane and the club face lies at the loft angle.

In such golf club head, even if a ball is struck off the sweet spot of the club face, since the rotation of the club head around the vertical axis is inhibited, a decrease in the initial speed of the struck ball is lessened.

Consequently, it has an advantage such that the carry distance loss is reduced.

The recent golf rules, however, limit a maximum value of the moment of inertia around the vertical axis. Therefore, it is required to develop a new technique being able to further improve the carry distance.

SUMMARY OF THE INVENTION

It is therefore, an object of the present invention to provide a golf club head which can increase carry distances of average golfers whose probability of off-center shot is relatively high.

Ball hitting test was made by average golfers whose club head speed ranges from 38 to 45 m/s in order to obtain the distribution of the hitting positions on the club face.

FIG. 11 shows the results of the hitting test, wherein one black dot (p) represents one or more hits.

From the test results, it was discovered that hitting positions of average golfers are distributed along a straight line h passing through the sweet spot SS and inclining downwardly towards the heel from the toe at an angle of about 28 degrees with respect to the horizontal plane HP.

From this, it was fond that, for further improving the carry distance, it is effective to control the rotation of the club head on off-center shots by increasing a moment of inertia Iy around an inclined axis passing through the center of gravity of the head and placed within a plane parallel with the above-mentioned vertical plane within which the shaft center line is placed and inclined downwardly toward the toe from the heel at angle θ1 of 62 degrees with respect to the horizontal plane.

Based on this finding, the present invention was made.

According to the present invention, a golf club head has a hollow structure and under a standard state in which the head is set on a horizontal plane so that a shaft center line is placed within a vertical plane and inclined at a fixed lie angle of 60 degrees with respect to the horizontal plane and the club face lies at the loft angle of the club head, a moment of inertia Ix of the club head around a vertical axis passing through the center of gravity of the head is 4500 to 5900 g sq·cm, a moment of inertia Iy of the club head around an inclined axis passing through the center of gravity of the head and inclined downwardly toward the toe from the heel at an angle θ of 62 degrees with respect to the horizontal plane within a plane parallel with the vertical plane within which the center line of the shaft is placed is 5300 to 6800 g sq·cm, and the moment of inertia Iy in g sq·cm and the moment of inertia Ix in g sq·cm satisfy $$Iy=<1.071\times Ix+482.$$

Preferably, the moment of inertia Iy around the inclined axis is more than the moment of inertia Ix around the vertical axis. Preferably, the volume of the head is 420 to 470 cc.

Further, according to the present invention, a method for predicting carry distance performance of a golf club head comprises:

a step of measuring a moment of inertia Iy of the club head around an inclined axis, wherein under a standard state in which the head is set on a horizontal plane so that a center line of a shaft is placed within a vertical plane and inclined at a fixed lie angle of 60 degrees with respect to the horizontal plane and the club face lies at the loft angle of the club head, the inclined axis is defined as passing through the center of gravity of the head and inclined downwardly toward the toe from the heel at an angle θ of 62 degrees with respect to a horizontal plane within a plane parallel with a vertical plane within which the center line of the shaft is placed; and a step of predicting a carry distance by the golf club head based on the measured value of the moment of inertia Iy around the inclined axis.

As explained, the moment of inertia Iy is that around the axis perpendicular to the above-mentioned straight line (h) shown in FIG. 11. Therefore, by setting the moment of inertia Iy at a relatively large value in a range of from 5300 to 6800 g sq·cm, even if a hitting position is varied as shown in FIG. 11, the rotation of the club head by the hitting can be effectively reduced, and the rebound performance can be improved.

As the moment of inertia Ix around the vertical axis is limited within a range of from 4500 to 5900 g sq·cm, the head comes into compliance with the golf rules.

Further, the following conditional relationship $$Iy=<1.071\times Ix+482 \text{ g sq·cm}$$

is satisfied. As a result, a wall thickness of the golf club head can not be excessively decreased, and the club head can be provided with durability.

Thus, in the golf club head according to the present invention, the moment of inertia around the inclined axis is increased while the moment of inertia around the vertical axis is limited to meet the golf rules. Therefor, even when off-center shot is made, the kinetic energy of the club head is effectively transferred to the ball so that the carry distance can be improved, while providing durability for the head.

In this application including the description and claims, positions, dimensions, directions and like of the club head refer to those under the standard state of the head unless otherwise noted.

The standard state of the head is such that, as shown in FIGS. 1 to 4, the head is set on a horizontal plane HP so that a shaft center line CL is placed within a vertical plane VP and inclined at a fixed lie angle alpha of 60 degrees with respect to the horizontal plane HP and the club face 2A becomes the loft angle beta of the head. The club face angle is zero. In the case of the head alone, the center line of the after-mentioned shaft inserting hole 7*e* of the hosel portion can be used instead.

The sweet spot SS is an intersecting point of a normal line (n) to the club face 2A drawn from the center of gravity G of the head with the club face 2A.

The edge of the club face 2A is defined by a virtual edge line (Pe) if the edge is unclear due to smooth change in the curvature. As shown in FIGS. 7(*a*) and 7(*b*), the virtual edge line (Pe) is determined based on the curvature change as follows. In each cutting plane E1, E2—including the sweet spot SS and the center G of gravity of the head, a point Pe at which the radius (r) of curvature of the profile line Lf of the club face first becomes under 200 mm in the course from the center SS to the periphery of the club face is determined. Then, the virtual edge line is defined as a locus of the determined points Pe.

BRIEF DESCRIPTION OF THE DRAWINGS

FIG. 3(*b*) is a view of the head rotated around the vertical axis by 45 degrees counterclockwise from the view of FIG. 1.

FIG. 4(*b*) is a side view of the head viewed from the toe-side.

FIG. 10(*b*) is a contour plot of the restitution coefficient of the after-mentioned embodiment Ex. 5.

DESCRIPTION OF THE PREFERRED EMBODIMENTS

Figure 1:
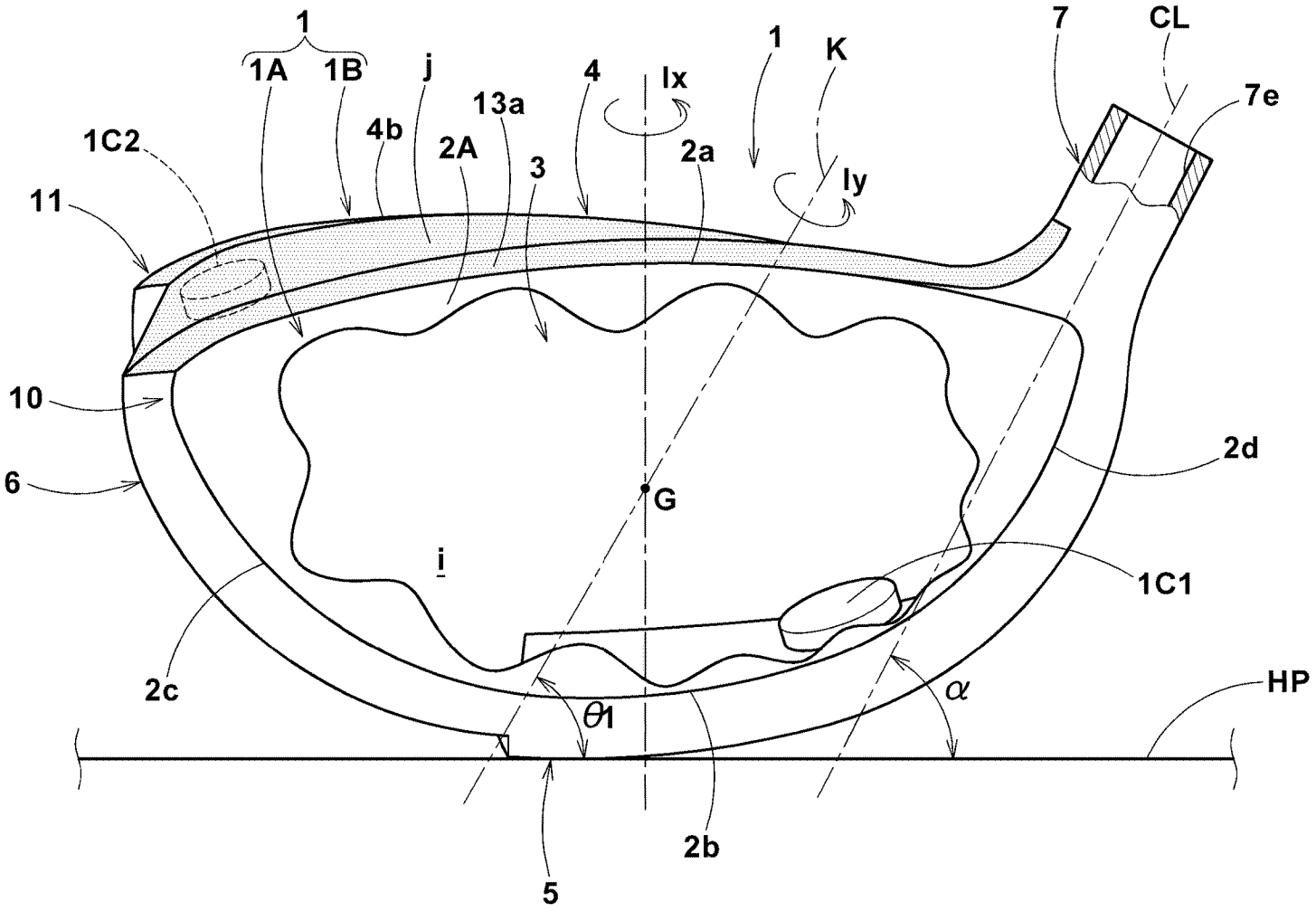
FIG. 1 is a front view of a golf club head as a first embodiment of the present invention.

Embodiments of present invention will now be described in detail in conjunction with accompanying drawings.

According to the present invention, a club head 1 can be formed as a wood-type head. e.g. driver (#1), fairway wood and the like having a hollow structure with a hollow (i) therein.

In the case of such wood-type head 1, it is preferable that the club head 1 has a volume of about 420 cc to about 470 cc. If the volume v is less than 420 cc, the club head 1 looks smaller and fails to give a sense of assurance at address, and there is a possibility that a sweet area becomes small. If the volume V exceeds 470 cc, since the mass of the club head increases, it becomes difficult to swing through the ball, and the head speed decreases. Further, it goes against the golf rules. In this light, the volume v is preferably not less than 425 cc, more preferably not less than 430 cc.

If the mass of the club head 1 is too small, there is a tendency that the kinetic energy of the club head decreases, and the carry distance can not be improved. If the mass is too large, there is a tendency that it becomes difficult to swing through the ball, and the carry distance and directional stability of the ball are deteriorated. In this light, the mass of the club head 1 is preferably set in a range of not less than 160 g, more preferably not less than 180 g, but not more than 240 g, more preferably not more than 220 g.

According to the present invention, the following conditions (I), (II) and (II) are satisfied:

(I) the moment of inertia Ix of the head around the vertical axis passing through the center of gravity of the head is 4500 to 5900 g sq·cm;

(II) the moment of inertia Iy of the head around the inclined axis K passing through the center of gravity of the head and inclined downwardly toward the toe from the heel at an angle θ of 62 degrees with respect to the horizontal plane within a plane parallel with the vertical plane within which the center line of the shaft is placed is 5300 to 6800 g sq·cm; and (III) the moment of inertia Iy (g sq·cm) around the inclined axis K and the moment of inertia Ix (g sq·cm) around the vertical axis satisfy: $Iy=<1.071\times Ix+482$ g sq·cm.

The moment of inertia Ix around the vertical axis which exceeds 5900 g sq·cm goes against the golf rules.

If the moment of inertia Ix around the vertical axis becomes less than 4500 g sq·cm, when the hitting position shifts toward the toe-side or heel-side of the center. the rotation of the club head can not be effectively restricted and the loss of the carry distance increases. Further, the moment of inertia Iy around the inclined axis K can not be increased.

If the moment of inertia Iy around the inclined axis K exceeds 6800 g sq·cm, the wall thickness of the club head 1 at positions distant from the inclined axis K has to be increased, and the thickness of the club head at positions closer to the inclined axis K has to be excessively decreased. Thus, the durability is deteriorated. If the moment of inertia Iy around the inclined axis becomes less than 5300 g sq·cm, the restitution coefficient decreases in the area of the hitting positions, and the loss of the carry distance increases.

Preferably, the moment of inertia Iy around the inclined axis K is not less than 6000 g sq·cm, more preferably not less than 6100 g sq·cm.

In order to increase the restitution coefficient in the area of the hitting positions of the average golfers, a larger value is preferred for the moment of inertia Iy around the inclined axis.

If the moment of inertia Iy around the inclined axis becomes more than the value of $1.071\times Ix+482$ g sq·cm, then there is a possibility that the wall thickness of the club head 1 is decreased to deteriorate the durability.

As explained above, the club head 1 according to the present invention is provided with a larger moment of inertia Iy around the inclined axis while complying with the golf rules. Therefore, the restitution coefficient is increased in the off-center shot area, and the kinetic energy of the club head can be effectively transferred to the ball even on off-center shot, and the carry distance can be improved and the golf club head can be provided with durability.

In order to bring out the above function more steady, the moment of inertia Iy around the inclined axis is preferably set to be more than the moment of inertia Ix around the vertical axis.

The club head 1 having such moment of inertia Ix and Iy can be obtained by allocating more weight to positions distant from the inclined axis K.

In this application, the restitution coefficient is meant for the coefficient of rebound of the golf ball calculated by the following experimental method.

In particular, by the use of a ball launcher, a golf ball is let off to hit the sweet spot SS of the club face of the club head placed on a pedestal at rest without being fixed thereto, and the collision velocity Vi of the golf ball and the rebound velocity Vo immediate after the collision are measured.

The restitution coefficient e is given by $$(Vo/Vi)=(e*M-m)/(M+m)$$

where

M is the mass of the club head, and m is the mass of the golf ball.

The distance from the mouth of the ball launcher to the club face is set at 55 inches. The ball is launched to hit the club face perpendicularly thereto at a distance less than 5 mm from the sweet spot. The initial velocity of the ball is set at 160+/−0.5 feet/sec (48.768+/−0.1524 meter/sec). As to the golf balls, Titleist's PINNACLE GOLD is used.

In the following embodiments, each club head 1 comprises: a face portion 3 having the club face 2A for hitting a ball; a crown portion 4 defining the top surface of the club head extending to the upper edge 2*a* of the club face 2A; a sole portion 5 defining the bottom face of the club head extending to the lower edge 2*b* of the club face 2A; a side portion 6 extending between the crown portion 4 and the sole portion 5 and extending from the toe-side edge 2*c* of the club face 2A to the heel-side edge 2*d* of the club face 2A through the back face 2B of the club head; and a hosel portion 7 provided in a heel-side part of the crown portion 4 and having a shaft inserting hole 7*e* into which the tip end of the club shaft (not shown) is inserted. The head has a hollow structure with a relatively thin wall.

The club head 1 can be formed by assembling a head main body 1A provided in a crown portion side with an opening O, and a crown member 1B fixed to the head main body 1A so as to close the opening O.

It is preferable that the head main body 1A is made of one or more kinds of metal materials including a metal material having a relatively large specific gravity, and the crown member 1B is made of a material having a specific gravity less than the metal material of the head main body 1A having a relatively large specific gravity. This helps to reduce the weight of the club head in its upper part to thereby increase the moment of inertia 1*y* around the inclined axis.

As to the materials for the head main body 1A, stainless steel, maraging steel, titanium alloy and the like are preferred. The head main body 1A can be manufactured through a technique of forging or casting. Further, it is also possible to manufacture the head main body by assembling two or more parts prepared for example by bending rolled materials and the like. Preferably, the head main body is formed as a single casting integrally molded.

As to the materials for the crown member 1B, fiber reinforced resin, titanium alloy, aluminum alloy, magnesium alloy and the like are preferred.

Further, a fiber reinforced resin material may be used to form a part of the head main body 1A excepting the face portion 3.

In order to achieve the above-mentioned relationship between the moment of inertia Ix and the moment of inertia Iy, for example, it is possible that the wall thickness of the club head 1 in any part is reduced as far as possible, and the reduced weight is assigned to a weight member 1C made of a high specific gravity material, then the weight member is disposed in a peripheral region of the club head 1.

Preferably, the weight member 1C has a specific gravity of not less than 7.0, more preferably not less than 10.0, still more preferably not less than 13.0, and the weight member 1C is made of a material having a relatively large specific gravity for example, an alloy comprising one or two or more of tungsten, nickelic, stainless steel and the like.

The weight member 1C is fixed directly to the surface of the hollow (i). But it is also possible to fix it to the club head 1 by the use of an attachment (not shown).

Figure 6:
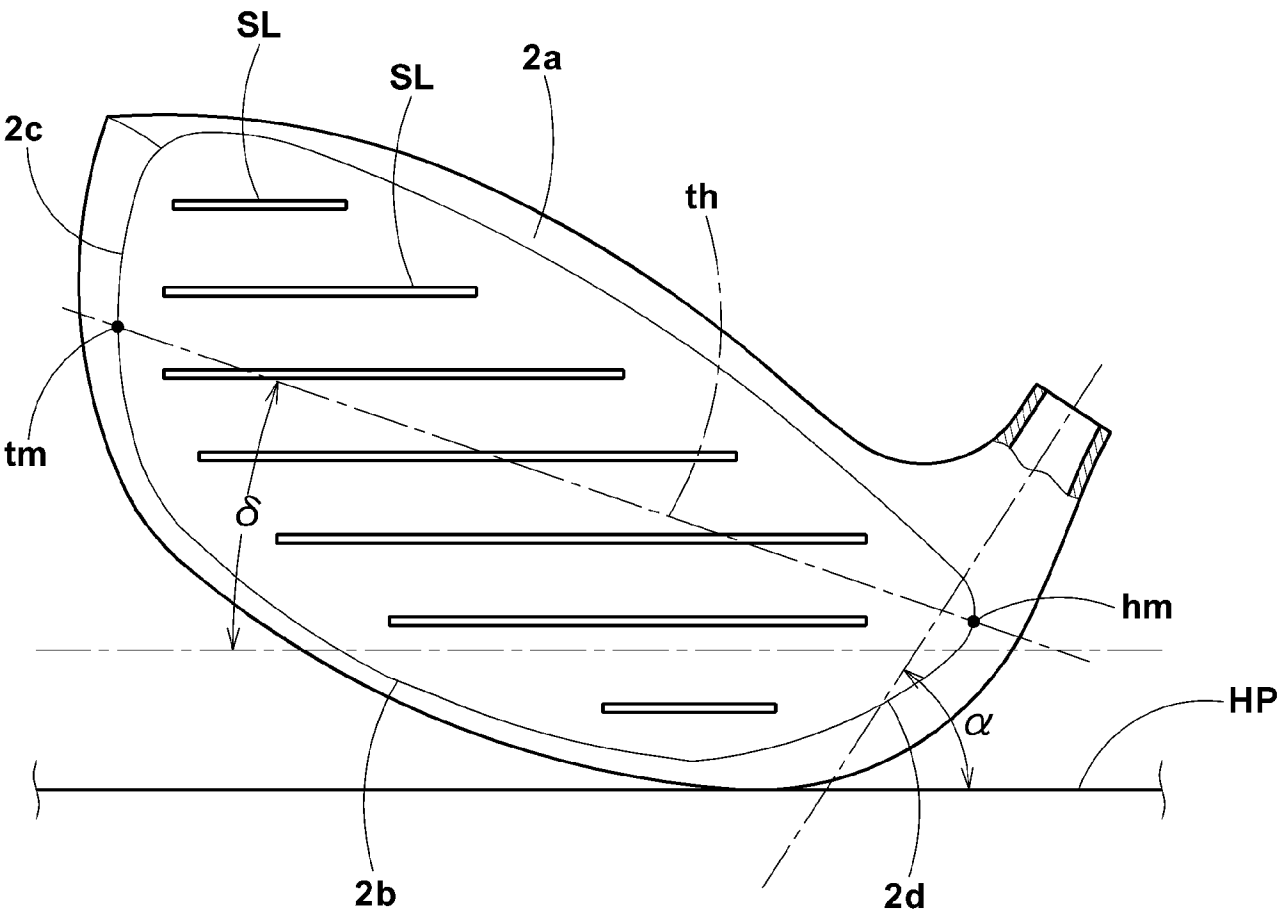
FIG. 6 is a front view of a golf club head as a second embodiment of the present invention.
Figure 7A:
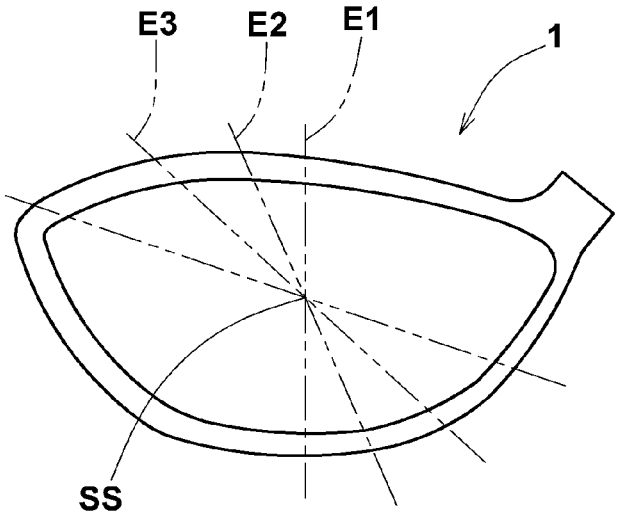
FIGS. 7(*a*) and 7(*b*) are a front view and a cross sectional view of a club face for explaining the edge of the club face.
Figure 7B:
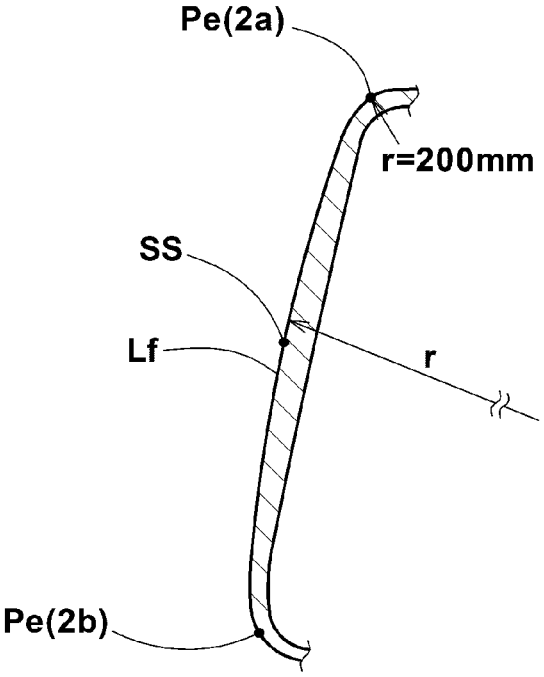

Further, the club head 1 can be provided in the club face 2A with score lines SL which extend straight and become parallel with the horizontal direction in the front view of the head under the standard state as shown in FIG. 6.

Incidentally, the above-mentioned loft angle is more than zero degree.

First Embodiment

FIGS. 1 to 4 show the club head 1 as a first embodiment of the present invention.

The club head 1 in this embodiment is composed of a fore part 10 including the face portion 3, and an aft part 11 connected to the fore part 10 forming a stepped part j in the crown portion 4, sole portion 5 and side portion 6.

The fore part 10 includes, in addition to the face portion 3, a face turnback 13 extending for a short distance from the edge of the face portion 3 toward the back face 2B.

The face turnback 13 includes:

a crown front part 13*a* extending backward from the upper edge 2*a* of the club face 2A;

a sole front part 13*b* extending backward from the lower edge 2 of the club face 2A;

a toe front part 13*c* extending backward from the toe-side edge 2*c* of the club face 2A; and a heel front part 13*d* extending backward from the heel-side edge 2*d* of the club face 2A.

Figure 2:
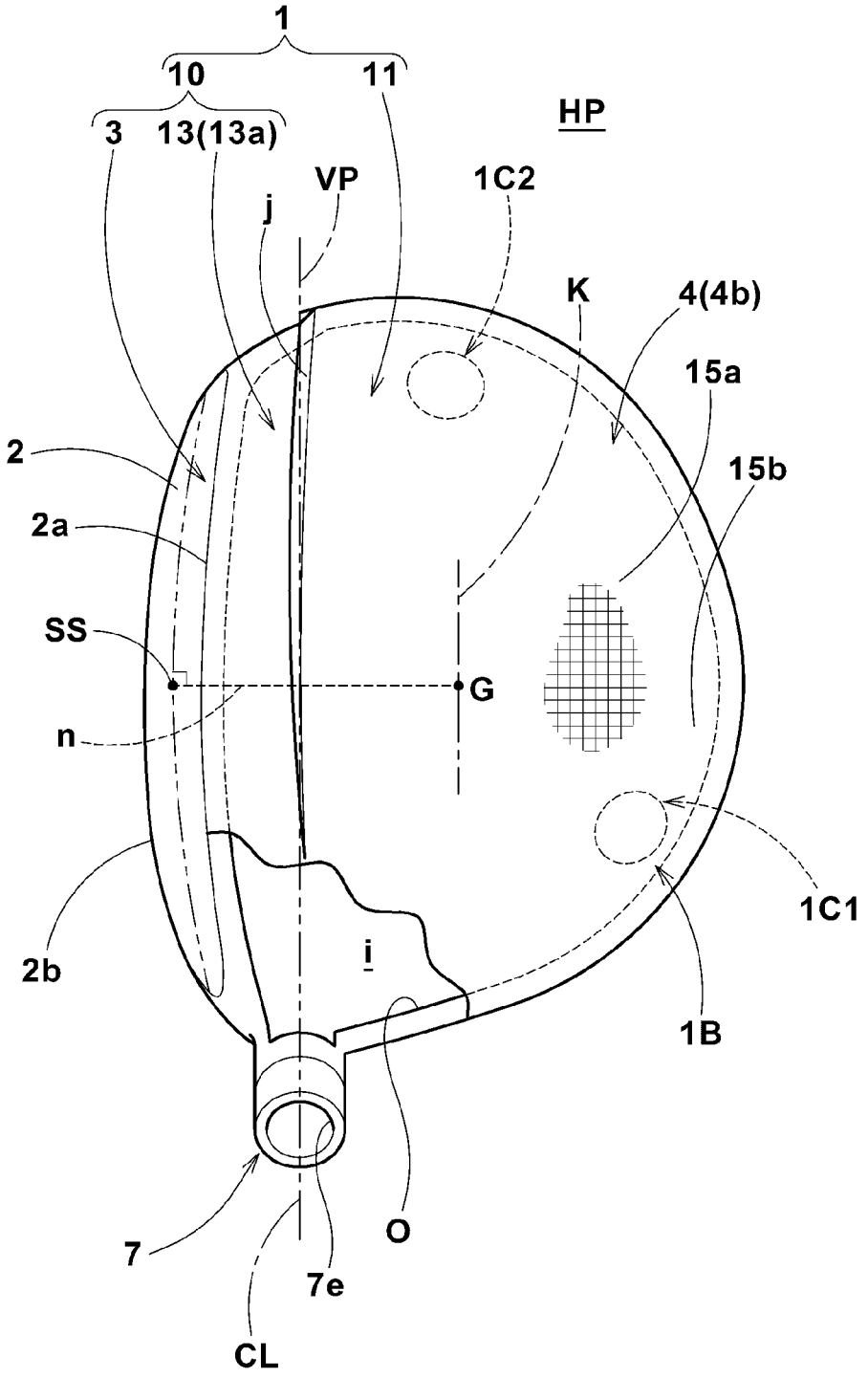
FIG. 2 is a plan view of the head.

As to the dimensions of the front parts 13*a*-13*c* in the front-back direction of the head, as shown in FIG. 2, the face turnback 13 in this embodiment substantially reaches to the vertical plane VP. But, it may be also possible to extend beyond or terminate before the vertical plane VP.

The aft part 11 includes:

a crown rear part 4*b* connected to the crown front part 13*a* through a stepped part j having a front face substantially parallel with the club face 2A;

a sole rear part 5*b* connected to the sole front part 13*b* through a stepped part j having a rear face substantially parallel with the club face 2A; and a side rear part 6*b* connected to the toe front part 13*c* through a stepped part j having a rear face substantially parallel with the club face 2A.

As is clear from the front view of the head under the standard state shown in FIG. 1, at least part of the crown rear part 4*b* on the toe-side of the center of gravity G of the head is positioned above the crown front part 13*a* due to the stepped part j.

Figure 5A:
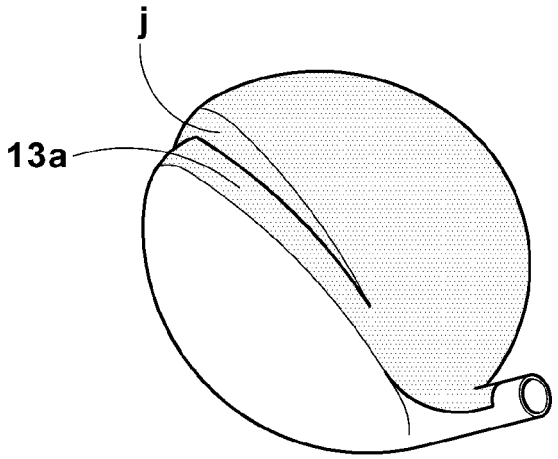
FIGS. 5(*a*), 5(*b*) and 5(*c*) are perspective views of the head viewed from various angles.
Figure 5B:
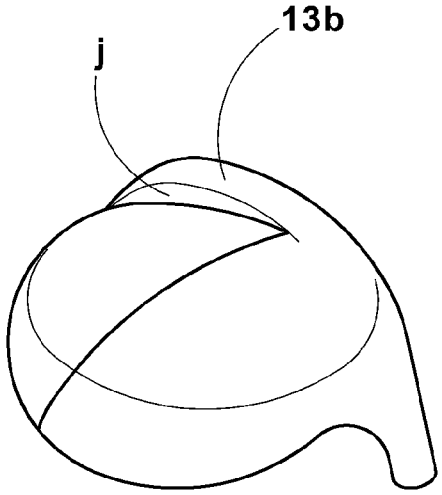
Figure 5C:
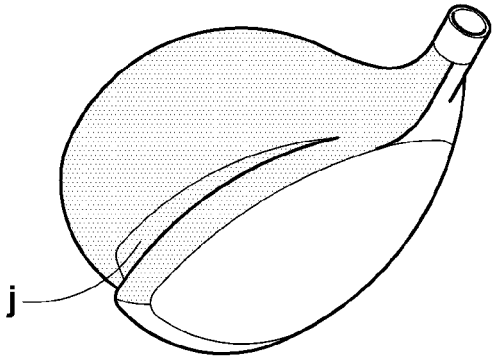

As shown in FIG. 5(*b*), at least part of the sole rear part 5*b* on the toe-side of the center of gravity G of the head is positioned above the sole front part 13*b* due to the stepped part j.

Figure 3A:
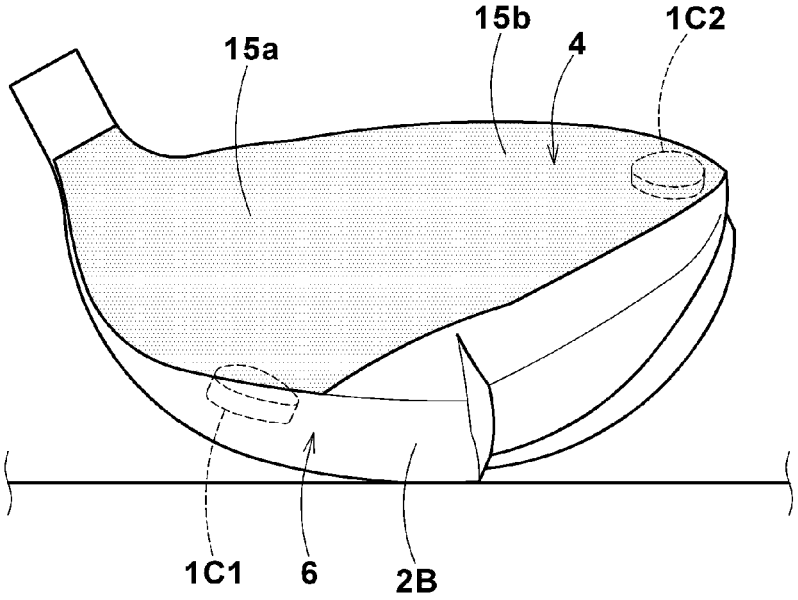
FIG. 3(*a*) is a rear view of the head.
Figure 3B:
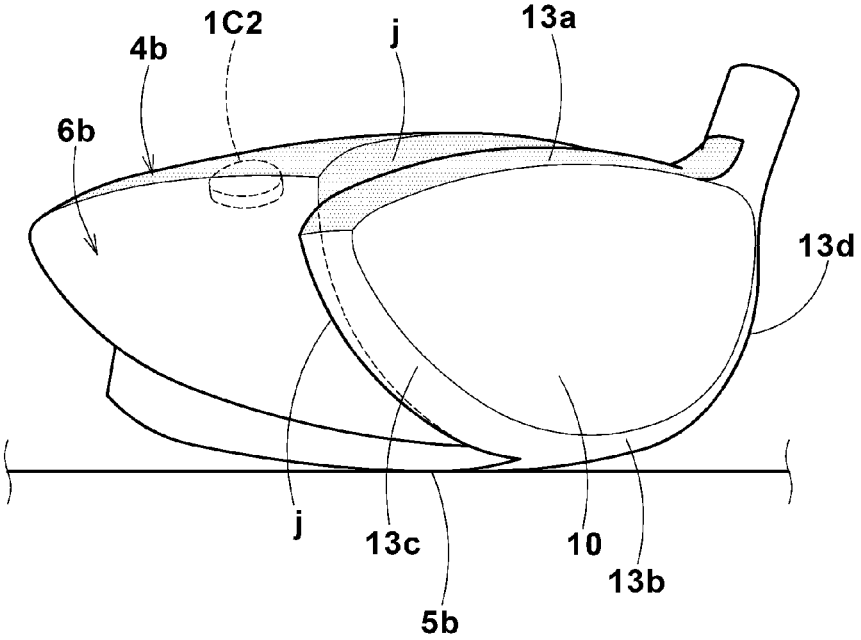
Figure 4A:
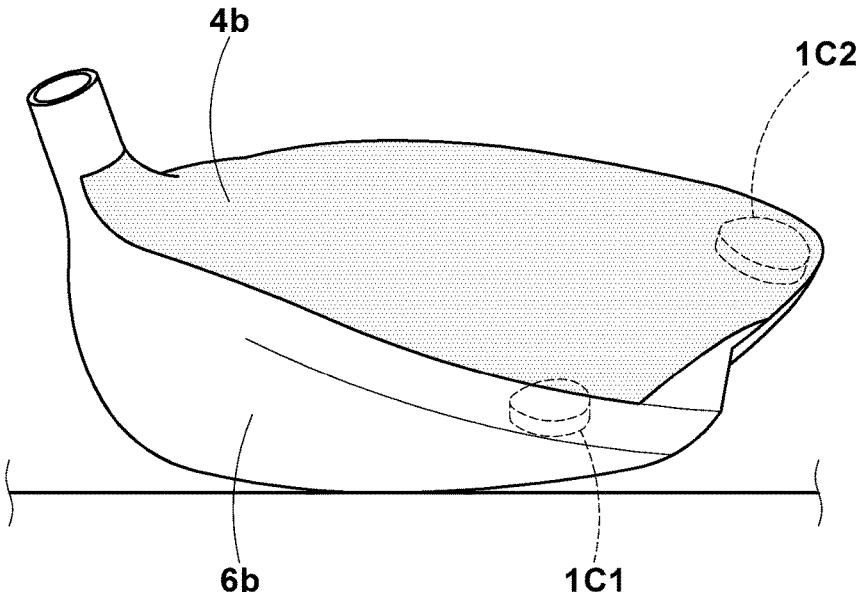
FIG. 4(*a*) is a view of the head rotated around the vertical axis by 45 degrees counterclockwise from the view of FIG. 3(*a*).
Figure 4B:
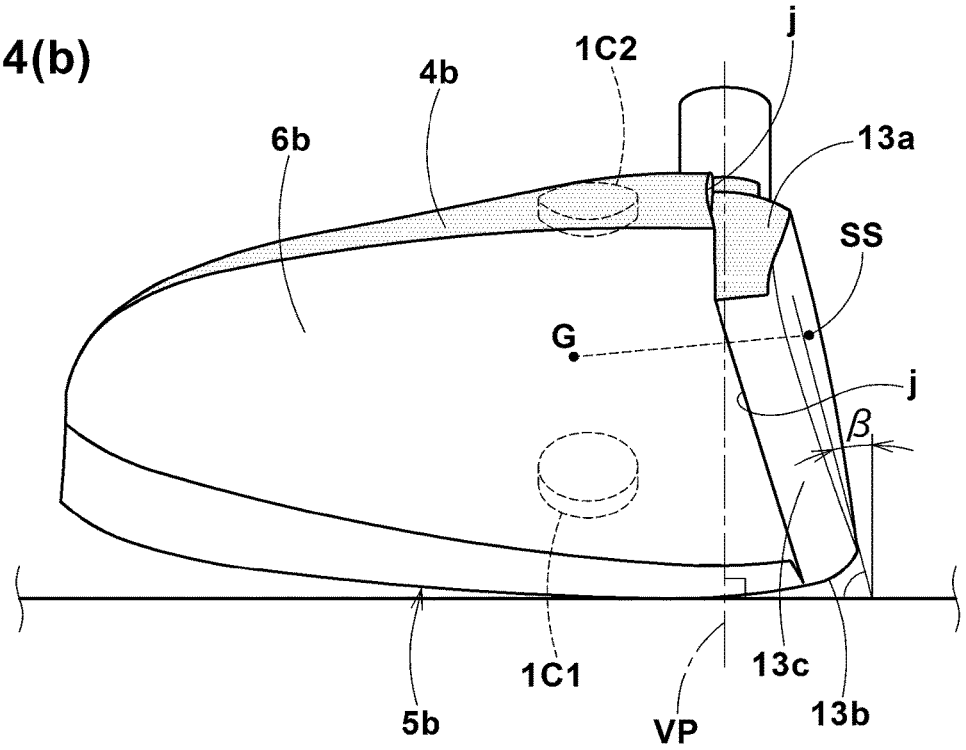

As shown in FIG. 3(*b*), the side rear part 6*b* is positioned on the heel-side of the toe front part 13*c* due to the stepped part j.

Accordingly, the club head 1 in this embodiment has a peculiar shape such that only a part of the aft part 11 positioned on the toe-side of the center of gravity G of the head is bent upwardly. In other words, the aft part 11 is twisted around an axis extending in the front-back direction of the head relatively to the fore part 10 such that the toe-side of the aft part 11 goes upward of the toe-side of the fore part 10 thereby forming the stepped parts j.

The outer surface of a part of the aft part 11 on the heel-side of the center of gravity G of the head is smoothly connected to the outer surface of the fore part 10.

As a results, it becomes possible for the club head 1 to have a mass distribution suitable for achieving the moment of inertia Iy around the inclined axis and the moment of inertia Ix around the vertical axis within the above-mentioned ranges.

In the club head 1 in this embodiment, the moment of inertia 1*y* (g sq·cm) around the inclined axis and the moment of inertia Ix (g sq·cm) around the vertical axis satisfy $$Iy<1.071\times Ix+482 \text{ g sq·cm}$$

and further $$Iy=<1.111\times Ix-255 \text{ g sq·cm.}$$

Therefore, the head can be easily manufactured while securing a necessary wall thickness for the head.

It is possible to use a single weight member 1*c*, but it is also possible dispose two or more weight members 1C as shown in FIGS. 1 to 4. In this example, two weight members 1C are disposed in the hollow (i), and include a weight member 1C1 disposed in a heel-side and back-side of the side portion 6 and a weight member 1C2 disposed in a toe-side of the crown portion 4 so as to be crossed by a plane including the center of gravity G of the head and extending parallel with the above-mentioned vertical plane VP.

In FIGS. 1, 3(*a*)-(*b*), 4(*a*)-(*b*), 5(*a*) and 5(*c*), the shaded area is the above-mentioned crown member 1B.

For example, the crown member 1B is made of a fiber reinforced resin material. In particular, it is preferred that the crown member 1B is made by laminating prepreg sheets. The rest, namely the head main body 1A is made of a metal material, such as a titanium alloy or the like

Second Embodiment

FIG. 6 shows the club head 1 as a second embodiment of the present invention.

In the club head 1 in this embodiment, the club face 2A has a contour shape such that, in the front view of the head under the standard state, a straight line (th), which is defined as extending between a toe-side point (tm) on the edge of the club face 2A at the toe-side extreme end and a heel-side point (hm) on the edge of the club face 2A at the heel-side extreme end, is inclined at an angle δ of not less than 15 degrees with respect to the horizontal plane HP.

The club head 1 in this embodiment has a shape belonging to the conventional wood-type than the peculiar twisted shape of the first embodiment.

Even so, in such club head 1, it becomes possible to effectively distribute the mass to positions distant from the inclined axis K, therefore, it is possible for the club head 1 to have a mass distribution suitable for achieving the moment of inertia Iy and Ix within the above-mentioned ranges.

In this embodiment too, one or more weight members 1C can be disposed as described in conjunction with the first embodiment.

Third Embodiment

Figure 8:
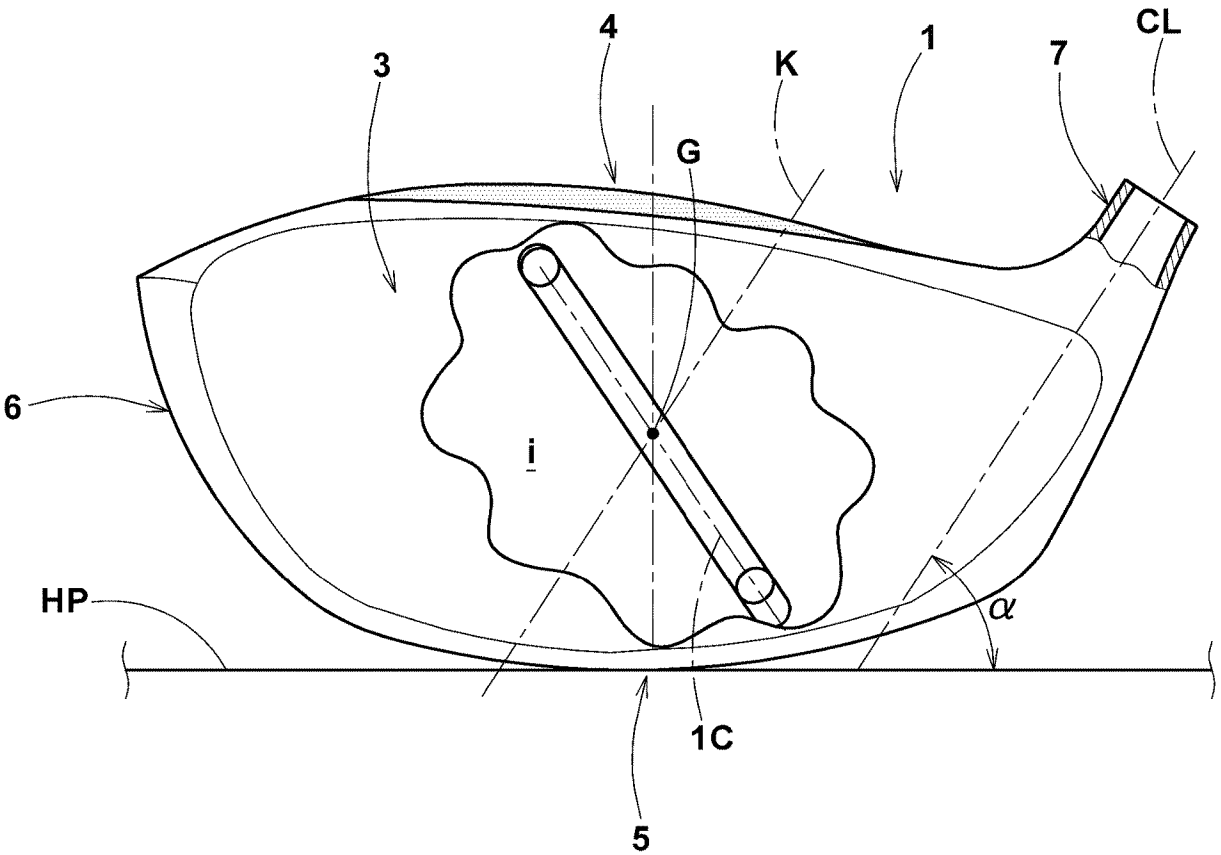
FIG. 8 is a front view of a golf club head as a third embodiment of the present invention.

FIG. 8 shows the club head 1 as a third embodiment of the present invention.

The club head 1 in this the embodiment is provided in the hollow (i) with a ring-shaped weight member 1C surrounding the inclined axis K or a plurality of circular arc weight members 1C arranged circularly to surround the inclined axis K.

In the front view of the head under the standard state, the circle, along which the weight member or members 1CR are arranged, is inclined downwardly toward the heel from the toe preferably at an angle of 56 degrees with respect to the horizontal plane HP.

The club head 1 in this embodiment also has a shape belonging to the conventional wood-type than the peculiar twisted shape of the first embodiment.

Such continuous ring-shaped weight member 1C or the circularly-arranged circular arc weight members 1C can be used in the above-mentioned first and second embodiments instead of a plurality of the weight members 1C having a shape like a block or button as shown in FIG. 1.

[Maximum Second-Order Moment Axis R of Club Face]

Here, a maximum second-order moment axis R is defined as an axis, which extends straight passing through the centroid z of a two-dimensional shape and about which the second-order moment z becomes maximum. The second-order moment z about an axis is the integration of the product of the area dA of a micro region in the 2-D shape and the square of the distance y thereto from the axis. Namely, $I=\int y^2\,dA$.

Figure 9:
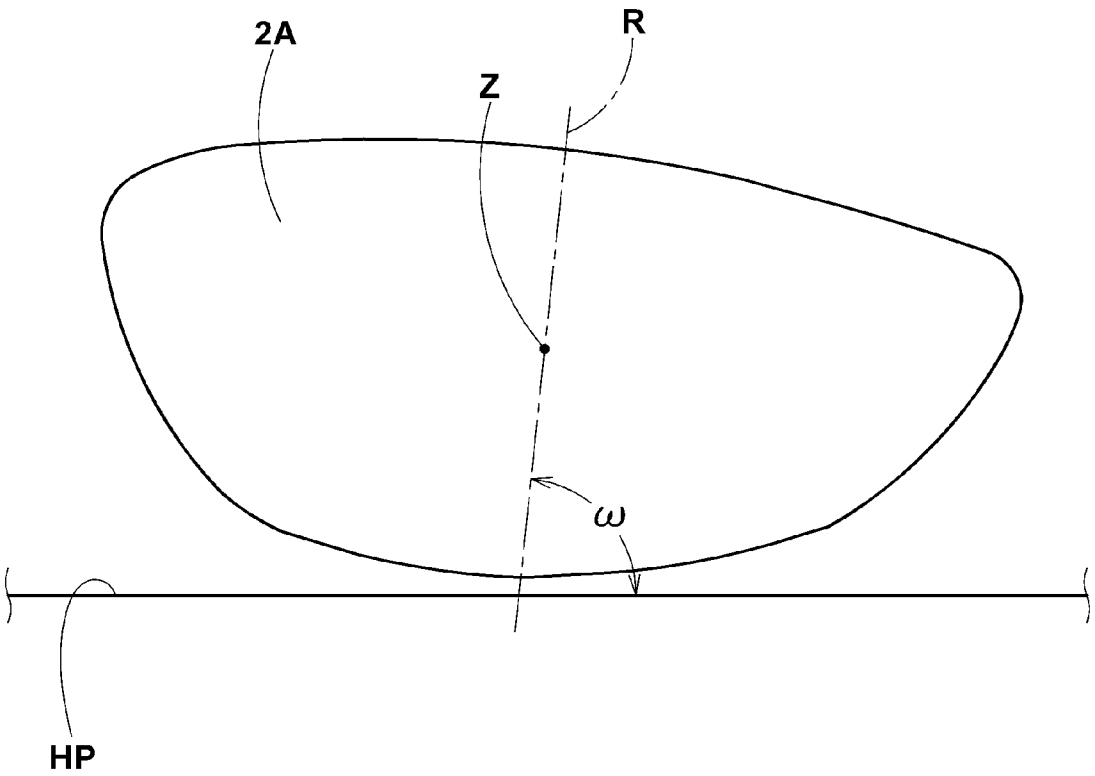
FIG. 9 is a diagram for explaining a maximum second-order moment axis passing through the centroid of the a club face.

In the second embodiment, as shown in FIG. 9, the two-dimensional shape of the club face 2A projected on the vertical plane VP has a maximum second-order moment axis R which lies at an angle ω in a range of from 0 to 75 degrees with respect to the horizontal plane HP.

In the first embodiment, the angle ω is in a range of from 75 to 90 degrees.

In the third embodiment, the angle ω is in a range of from 75 to 90 degrees.

[Method for Predicting Carry Distance Performance of Club Head]

Next, a method for predicting carry distance performance of a club head is described.

Firstly, plural kinds of club heads, which are different from each other in respect of at least one of the shape of the head, the mass of weight member(s) 1C and the position(s) of weight member(s) 1C, are prepared, and the club heads are each measured for the moment of inertia Iy around the inclined axis and the moment of inertia Ix around the vertical axis.

The moment of inertia can be measured, for example, by the use of a measurement instrument such as Moment of Inertia Measuring Instrument manufactured by INERTIA DYNAMICS Inc.

Then, the plural kinds of the club heads are attached to club shafts to make golf clubs. Using the golf clubs, actual ball hitting tests are made by average golfers in order to obtain the average carry distance of each club. From the average carry distance and the moment of inertia Iy and Ix, a correlation table (not shown) of these parameters is prepared.

In order to predict carry distance performance of an object club head, the head is measured for the moment of inertia Iy around the inclined axis K and the moment of inertia Ix around the vertical axis.

Using the measured value of the moment of inertia Iy around the inclined axis K, the correlation table is looked up to obtain the corresponding average carry distance as the predicted or estimated carry distance performance of the object club head.

Therefore, by employing this method for predicting carry distance performance, the carry distance performance of a club head can be easily predicted without making an actual test by golfers.

Comparison Tests

In order to confirm the effects of the invention, a computer simulation was made.

Wood-type golf club heads (driver) having a conventional shape (Ref. 1), the structure shown in FIGS. 1 to 4 and the structure shown in FIG. 6 were numerically modeled by the use of a computer. The specifications are shown in Table 1.

By simulating the above-mentioned experimental method, the restitution coefficient was determined, and the restitution coefficient ratio was obtained therefrom, wherein the restitution coefficient ratio is the ratio (e2/e1) of the restitution coefficient e2 at any point in the club face to the restitution coefficient e1 at the sweet spot SS.

Further, the minimum wall thickness occurring in the crown portion or sole portion was obtained.

Figure 10A:
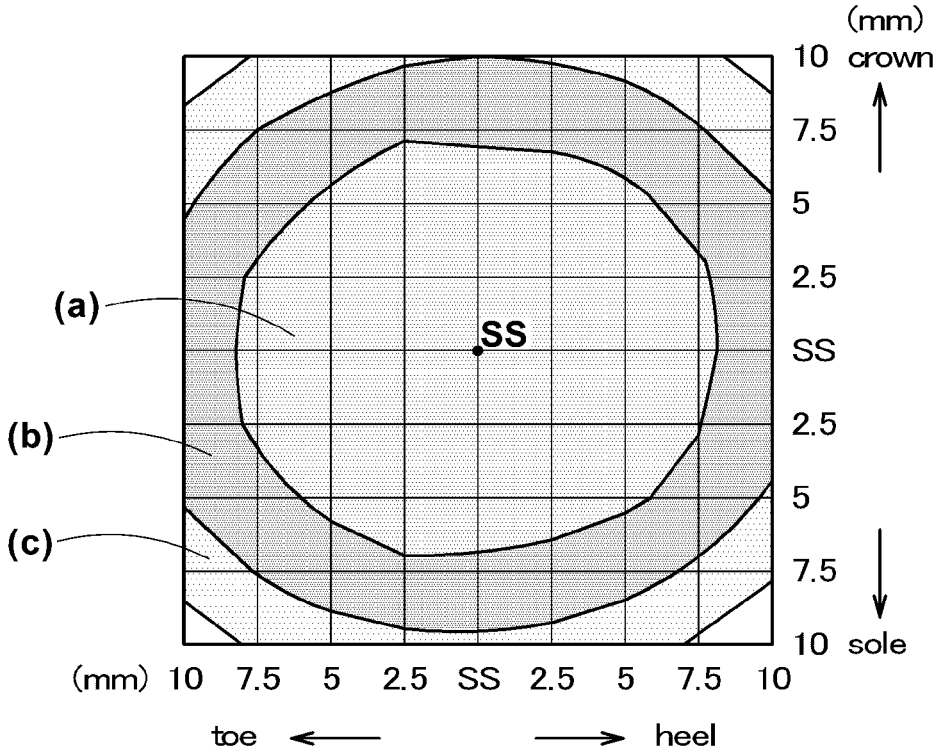
FIG. 10(*a*) is a contour plot of the restitution coefficient of the after-mentioned comparative example Ref. 1.
Figure 10B:
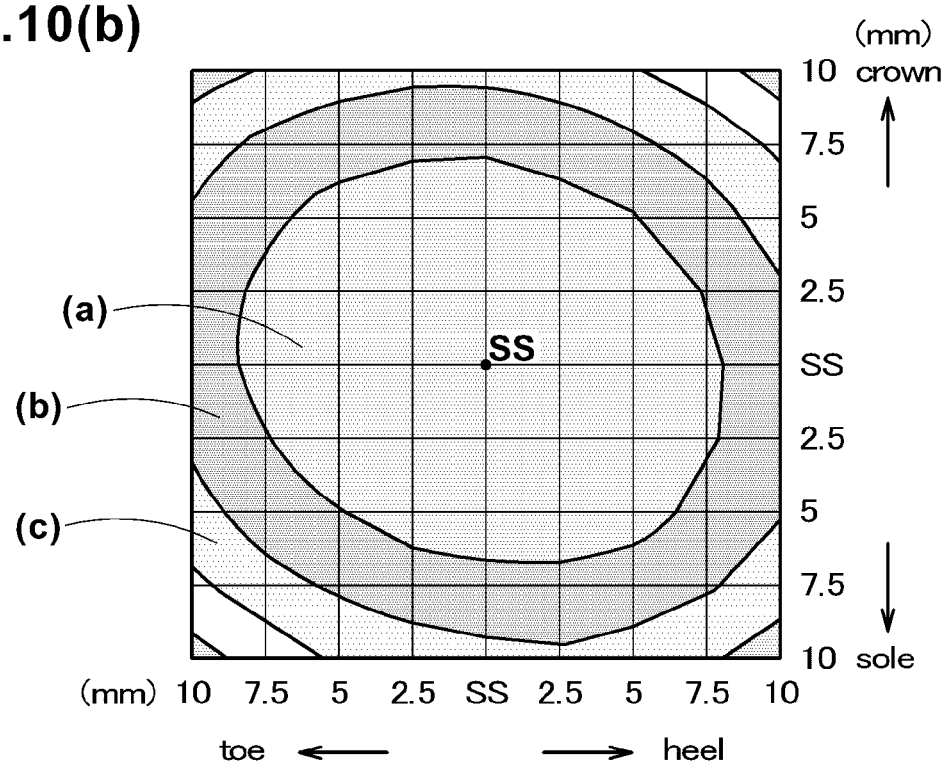

Each head was composed of the head main body made of a titanium alloy having a specific gravity of 4.42 and the crown member made of a fiber reinforced resin material having a specific gravity of 1.40. Except for the specifications shown in Table 1, all of the heads had the same specifications some of which are as follows.

lie angle alpha: 60 degrees
loft angle beta: 9.6 degrees
head volume: 460 cc
mass of club head: 210 g
angle θ1 of inclined axis: 62 degrees
wall thickness of face portion: 2.8 mm FIG. 10(*a*) is a contour plot of the restitution coefficient ratio of the comparative example head Ref. 1 around the sweet spot SS. FIG. 10(*b*) is a contour plot of the restitution coefficient ratio of the embodiment head Ex. 5 around the sweet spot SS. In the figures, the zones (a), (b) and (c) represent the following restitution coefficient.

(a): 0.995 to 1.000
(b): 0.990 to 0.995
(c): 0.985 to 0.990

Figure 11:
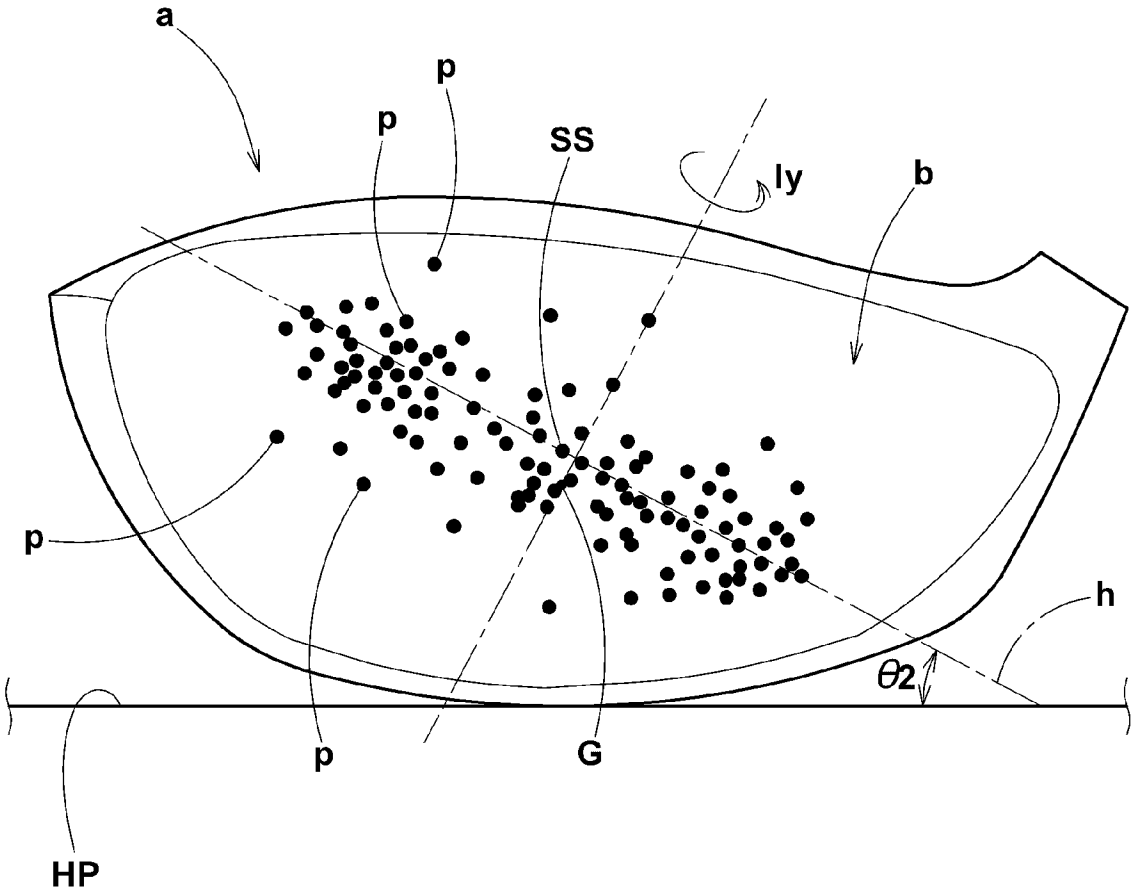
FIG. 11 is a diagram showing a typical distribution of hitting positions of average golfers.

From the simulation results, it was confirmed that, in contrast to the contour plot of Comparative example Ref. 1 not satisfying the above-mentioned conditions (I), (II) and (II), the contour plot of embodiment Ex. 5 satisfying the conditions (I), (II) and (II) is inclined corresponding to the distribution of hitting positions of average golfers shown in FIG. 11.

Also in the case of other embodiments satisfying the conditions (I), (II) and (II), contour plots similar to FIG. 10(*b*) could be obtained.

Further, for each head, the restitution coefficient ratio at a position apart from the sweet spot SS by 30 mm toward the heel-side and 15 mm toward the sole-side was obtained. The results are shown in Table 1.

The value of the restitution coefficient ratio at this position will give an indication of the rebound performance of the club head when the hitting position is distributed as shown in FIG. 11.

From the simulation results, it was confirmed that, in comparison with the comparative example golf club heads, the embodiment golf club heads was significantly improved in the rebound performance while the durability was maintained as a substantial wall thickness could be secured.

While preferred embodiments of the present invention have been described in conjunction with the accompanying drawings, such description is for illustrative purposes only, and it is to be understood that changes and variations may be made without departing from the spirit or scope of the following claims.

TABLE 1

| Head | Ref. 1 | Ex. 1 | Ex. 2 | Ex. 3 | Ex. 4 | Ref. 2 |
|---|---|---|---|---|---|---|
| club head shape (FIG. No.) | — | 1 | 1 | 1 | 6 | 6 |
| moment of inertia Iy around inclined axis (g sq · cm) | 5200 | 5300 | 5300 | 5300 | 5300 | 5400 |
| moment of inertia Ix around vertical axis (g sq · cm) | 5900 | 5900 | 5300 | 5000 | 4500 | 4500 |
| 1.071 × Ix + 482 (g sq · cm) | 6801 | 6801 | 6158 | 5837 | 5302 | 5302 |
| minimum wall thickness (mm) [0.3 mm or more is good] | 0.6 | 0.3 | 0.3 | 0.3 | 0.3 | 0.2 |
| restitution coefficient ratio [0.870 or more is good] | 0.869 | 0.872 | 0.876 | 0.873 | 0.877 | 0.879 |

| Head | Ex. 5 | Ex. 6 | Ex. 7 | Ref. 3 | Ref. 4 | Ex. 8 |
|---|---|---|---|---|---|---|
| club head shape (FIG. No.) | 1 | 1 | 6 | 6 | 6 | 6 |
| moment of inertia Iy around inclined axis (g sq · cm) | 5900 | 6300 | 6800 | 6900 | 5800 | 5700 |
| moment of inertia Ix around vertical axis (g sq · cm) | 5900 | 5900 | 5900 | 5900 | 4900 | 4900 |
| 1.071 × Ix + 482 (g sq · cm) | 6801 | 6801 | 6801 | 6801 | 5730 | 5730 |
| minimum wall thickness (mm) [0.3 mm or more is good] | 0.3 | 0.3 | 0.3 | 0.2 | 0.2 | 0.3 |
| restitution coefficient ratio [0.870 or more is good] | 0.899 | 0.912 | 0.929 | 0.938 | 0.894 | 0.890 |

| Head | Ref. 5 | Ex. 9 | Ref. 6 | Ex. 10 | Ex. 11 | Ex. 12 |
|---|---|---|---|---|---|---|
| club head shape (FIG. No.) | 6 | 6 | 6 | 6 | 1 | 1 |
| moment of inertia Iy around inclined axis (g sq · cm) | 6100 | 6000 | 6500 | 6400 | 5500 | 5400 |
| moment of inertia Ix around vertical axis (g sq · cm) | 5200 | 5200 | 5600 | 5600 | 5500 | 5500 |
| 1.071 × Ix + 482 (g sq · cm) | 6051 | 6051 | 6480 | 6480 | 6373 | 6373 |
| minimum wall thickness (mm) [0.3 mm or more is good] | 0.2 | 0.3 | 0.2 | 0.3 | 0.3 | 0.3 |
| restitution coefficient ratio [0.870 or more is good] | 0.911 | 0.905 | 0.926 | 0.919 | 0.880 | 0.874 |

| Head | Ex. 13 | Ex. 14 | Ex. 15 | Ex. 16 | Ex. 17 | Ex. 18 |
|---|---|---|---|---|---|---|
| club head shape (FIG. No.) | 1 | 1 | 6 | 1 | 6 | 1 |
| moment of inertia Iy around inclined axis (g sq · cm) | 5700 | 5600 | 5700 | 5600 | 6000 | 5900 |
| moment of inertia Ix around vertical axis (g sq · cm) | 5700 | 5700 | 5300 | 5300 | 5600 | 5600 |
| 1.071 × Ix + 482 (g sq · cm) | 6587 | 6587 | 6158 | 6158 | 6480 | 6480 |
| minimum wall thickness (mm) [0.3 mm or more is good] | 0.3 | 0.3 | 0.3 | 0.3 | 0.3 | 0.3 |
| restitution coefficient ratio [0.870 or more is good] | 0.890 | 0.882 | 0.895 | 0.886 | 0.910 | 0.897 |

The invention claimed is:

1. A hollow golf club head having a moment of inertia Ix of 4500 to 5900 g sq·cm and a moment of inertia Iy of 5300 to 6800 g sq·cm, which satisfy the following conditional expression:

$$Iy=<1.071\times Ix+482 \text{ g sq·cm}$$

wherein the moment of inertia Ix is a moment of inertia of the head around a vertical axis which is defined as passing through the center of gravity of the head under a standard state in which the head is set on a horizontal plane so that a shaft center line is inclined at a lie angle of 60 degrees with respect to the horizontal plane within a vertical plane and a club face of the head lies at the loft angle of the head, and the moment of inertia Iy is a moment of inertia of the head around an inclined axis which is defined as passing through the center of gravity of the head and inclined downwardly toward the toe of the head from the heel of the head at 62 degrees with respect to the horizontal plane within a plane parallel with said vertical plane.

2. The golf club head according to claim 1, wherein the moment of inertia Iy is more than the moment of inertia Ix.

3. The golf club head according to claim 2, wherein the moment of inertia Iy is from 5700 g sq·cm to 6800 g sq·cm.

4. The golf club head according to claim 3, which has a hollow structure comprising:

a face portion having the club face for hitting a ball;

a crown portion defining the top surface of the club head extending to the upper edge of the club face;

a sole portion defining the bottom face of the club head extending to the lower edge of the club face;

a side portion extending between the crown portion and the sole portion and extending from the toe-side edge of the club face to the heel-side edge of the club face through the back face of the club head; and a hosel portion provided in a heel-side part of the crown portion.

5. The golf club head according to claim 4, wherein the volume of the head is 420 to 470 cc.

6. The golf club head according to claim 1, wherein the moment of inertia Iy is from 5700 g sq·cm to 6800 g sq·cm.

7. The golf club head according to claim 1, wherein the moment of inertia Iy is from 6000 g sq·cm to 6800 g sq·cm.

* * * * *